US009696029B2

(12) United States Patent
Boecker

(10) Patent No.: US 9,696,029 B2
(45) Date of Patent: Jul. 4, 2017

(54) METHOD FOR ERECTING A BOILER, MODULE AND BOILER COMPRISING THE MODULE

(71) Applicant: ALSTOM Technology Ltd, Baden (CH)

(72) Inventor: Christoph Boecker, Stuttgart (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 150 days.

(21) Appl. No.: 14/684,800

(22) Filed: Apr. 13, 2015

(65) Prior Publication Data

US 2015/0292733 A1 Oct. 15, 2015

(30) Foreign Application Priority Data

Apr. 15, 2014 (EP) ..... 14164685

(51) Int. Cl.
*F22B 31/00* (2006.01)
*F22B 37/24* (2006.01)
*F22B 37/00* (2006.01)

(52) U.S. Cl.
CPC ..... *F22B 37/24* (2013.01); *F22B 37/001* (2013.01); *F22B 37/244* (2013.01)

(58) Field of Classification Search
CPC ..... F22B 37/24; Y10T 29/49387; Y10T 29/49904; F24H 1/181
USPC ..... 122/493, 496, 512; 29/429, 469, 29/890.051; 52/745.02, 745.03, 745.04
See application file for complete search history.

(56) References Cited

U.S. PATENT DOCUMENTS

| | | | | |
|---|---|---|---|---|
| 4,231,148 | A * | 11/1980 | Harding | B66B 19/002 29/469 |
| 7,275,503 | B2 * | 10/2007 | Waseda | F28F 9/013 122/510 |
| 8,191,257 | B2 * | 6/2012 | Reiner | F22B 37/001 237/58 |
| 9,140,446 | B2 * | 9/2015 | Higgins | F22B 21/00 |
| 2001/0023665 | A1 | 9/2001 | Heidrich | |
| 2005/0072000 | A1 * | 4/2005 | Gartner | F22B 37/244 29/890.051 |
| 2007/0089296 | A1 | 4/2007 | Tatehira et al. | |

FOREIGN PATENT DOCUMENTS

| | | | |
|---|---|---|---|
| AU | 2006200834 | B2 | 8/2011 |
| DE | 102005009592 | B4 | 9/2007 |
| EP | 1136754 | B1 | 12/2004 |
| JP | H04257602 | A | 9/1992 |
| JP | H11211003 | A | 8/1999 |

* cited by examiner

*Primary Examiner* — Gregory A Wilson
(74) *Attorney, Agent, or Firm* — GE Global Patent Operation; Stephen G. Midgley

(57) ABSTRACT

The method for erecting a boiler includes erecting a main structure, providing preassembled modules defining a boiler section, installing the modules outside the main structure.

8 Claims, 8 Drawing Sheets

METHOD FOR ERECTING A BOILER, MODULE AND BOILER COMPRISING THE MODULE

CROSS-REFERENCE TO RELATED APPLICATIONS

This application claims priority to European application 14164685.1 filed Apr. 15, 2014, the contents of which are hereby incorporated in its entirety.

TECHNICAL FIELD

The present disclosure relates to a method for erecting a boiler, module and boiler comprising the module.

The boiler is preferably a large boiler of a power plant. For example the boiler is a tower boiler, but also other types of boilers are possible, such as 2-pass boilers.

BACKGROUND

In order to erect a boiler, traditionally a main structure (main steel structure) is installed and then all the boiler components are sequentially installed one-by-one on and around the main structure.

Thus for example, the sequence could be main structure erection, installation of buckstays/headers and vertical heat exchanging walls at the upper part of the main structure, installation of internal heating surfaces (economizer, reheater, super heater), thus installation of the vertical heat-exchanging walls at the lower part of the main structure.

Then also the flue gas duct and other components such as piping, insulation, auxiliaries, cable trays, etc. are installed, typically outside of the main structure; these installations are carried out by lifting the component to be integrated into the boiler by a crane and connecting them to the required position. Usually the parts at the bottom are installed first and the parts at the upper part are then installed above the already installed parts at the bottom of the boiler.

The traditional method has the drawbacks that since the different components are one-by-one and sequentially installed, the boiler erection is very time consuming.

SUMMARY

An aspect of the disclosure includes providing a method, module and boiler that permit a reduction of the overall erection time of a boiler.

This and further aspects are attained by providing a method, module and boiler in accordance with the accompanying claims.

Advantageously, according to the method it is not needed to have a large crane available over the whole erection time. Large cranes were needed to move the large number of components to be positioned in different locations within and around the main structure. Use of large cranes can be disadvantageous during erection, because they can move only one component at a time and if more cranes are provided they can hinder with each other.

In addition, advantageously according to the method modules to be integrated into the boiler are assembled on the ground (i.e. at zero level), such that since assembling at high altitude is avoided greater safety is achieved.

BRIEF DESCRIPTION OF THE DRAWINGS

Further characteristics and advantages will be more apparent from the description of a preferred but non-exclusive embodiment of the method, module and boiler, illustrated by way of non-limiting example in the accompanying drawings, in which.

DETAILED DESCRIPTION

Figure 1:
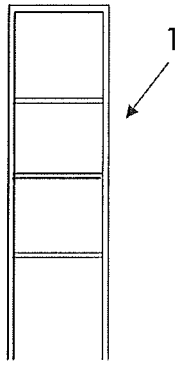
FIGS. 1 through 7 show a first embodiment of the method.

With reference to the figures, these show a method for erecting a boiler according to a modular method of construction.

According to the method, a main structure 1 (also called main steel structure) is erected, thus preassembled modules 3 defining boiler sections are provided and are installed outside of the main structure 1.

Since modules defining boiler sections are preassembled such that heavy, single components do not need to be lifted and handled during installation, a crane (such as a large crane) is not needed during installation of the modules 3; therefore a crane may be used when needed for the erection of the main structure 1, then the crane can be removed and installation of the remaining components is preferably carried out by strand jacks.

Tubed heat-exchanging surfaces 4*a-d* (such as the tubed walls of the economizer 4*a* (when provided), of the re-heater 4*b* (when provided), of the super heater 4*c* (when provided), of the evaporator 4*d*) are connected to the main structure 1 (typically inside the main structure) and are usually supported by it.

These tubed heat exchanging surfaces 4*a-d* are installed after the main structure 1 is erected, for example they are installed before and/or at the same time as (i.e. in parallel with) the assembling of the modules 3; after installation, the tubed heat exchanging surfaces 4*a-d* are supported by the main structure 1. Preferably the tubed heat exchanging surfaces 4*a-d* are within the footprint 5 of the main structure 1.

Installation of the exchanging surfaces 4*a-d* can be done through strand jacks 7 installed on the main structure 1. Typically the roof 11 of the boiler is installed first, then the economizer 4*a*, thus the reheater 4*b*, then the super heater 4*c* and the evaporating walls 4*d*.

Preferably, the modules 3 are preassembled on the ground, this allows an easy, quick and safe operation. In addition the modules 3 are preassembled outside the final footprint 6 of the boiler. This allows the modules to be preassembled without hindering the boiler erection, such that the total erection time for the boiler can be reduced. For the same reason of reducing the total erection time for the boiler, the modules 3 are preferably already preassembled during the main structure 1 erection.

For example, during installation the modules 3 are connected outside of the main structure to one or more other modules and/or to the main structure 1 and/or to a permanent lifting structure. In the following three examples of different embodiments of the method are described.

Example 1—Erection with Temporary Lifting Structure

Figure 2:
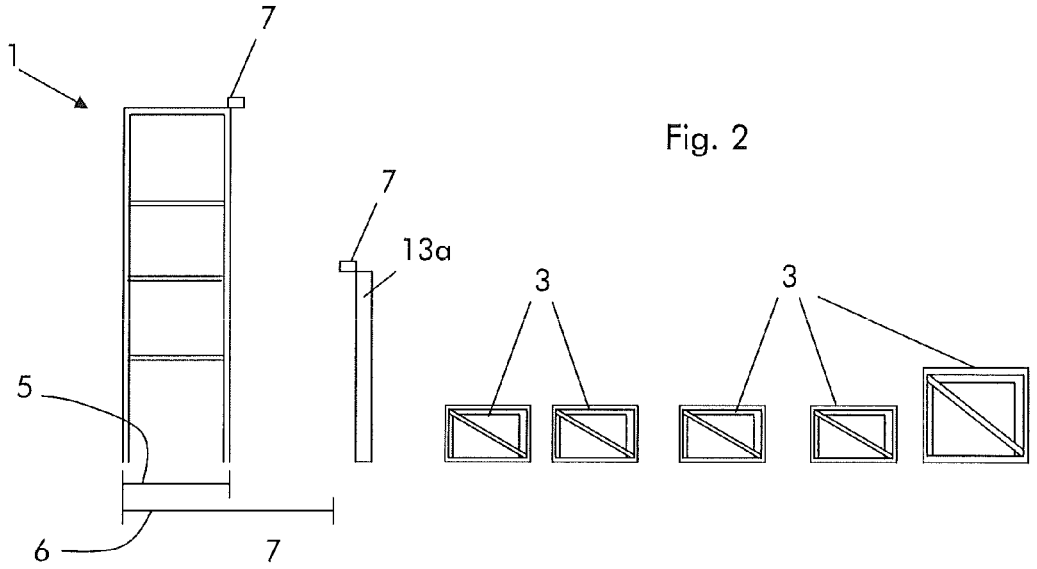
Figure 3:
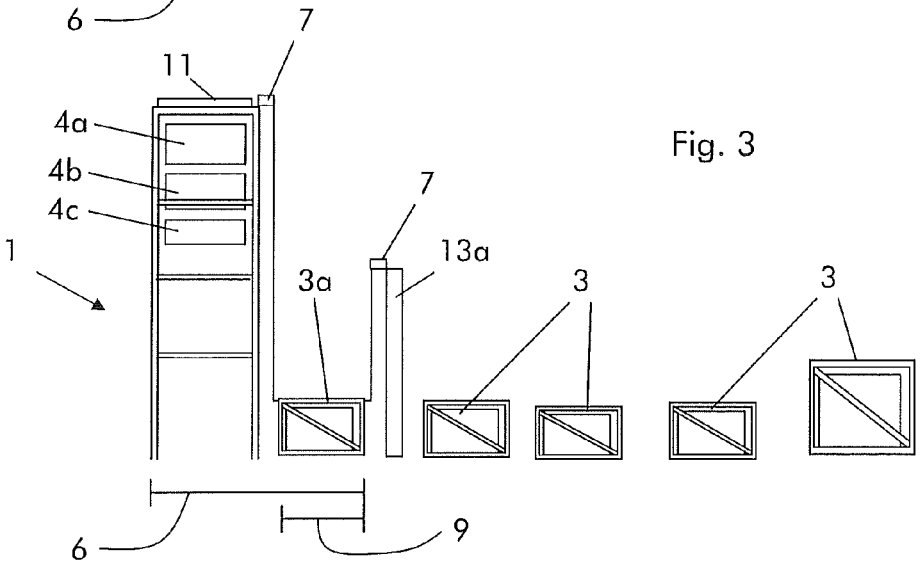

In a first embodiment of the invention (shown in FIGS. 1-7) the main structure 1 is built first (FIG. 1), thus one or more temporary lifting structures including lifting towers 13*a* are installed beside the main structure 1; strand jacks 7 are preferably provided on the lifting towers 13*a* and on the main structure 1 and the modules 3 are provided ready to be installed (FIG. 2).

Figure 4:
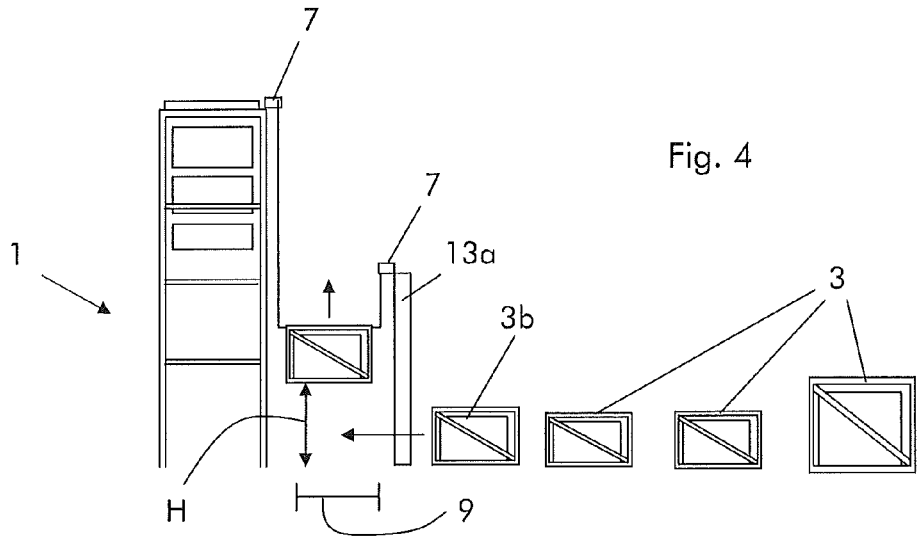

Thus a module 3*a* is placed, preferably in its final footprint 9 (FIG. 3) and it is lifted by the strand jacks of a height H large enough to allow positioning of an additional module 3*b* below the module 3*a* (FIG. 4).

An additional module 3*b* in thus provided and the module 3*a* is positioned on the top of the additional module 3*b* (and thus the additional module 3*b* is positioned below the module 3*a*, preferably in its final footprint 9); the module 3*a* and additional module 3*b* are thus connected together in order to define a group of modules.

Figure 5:
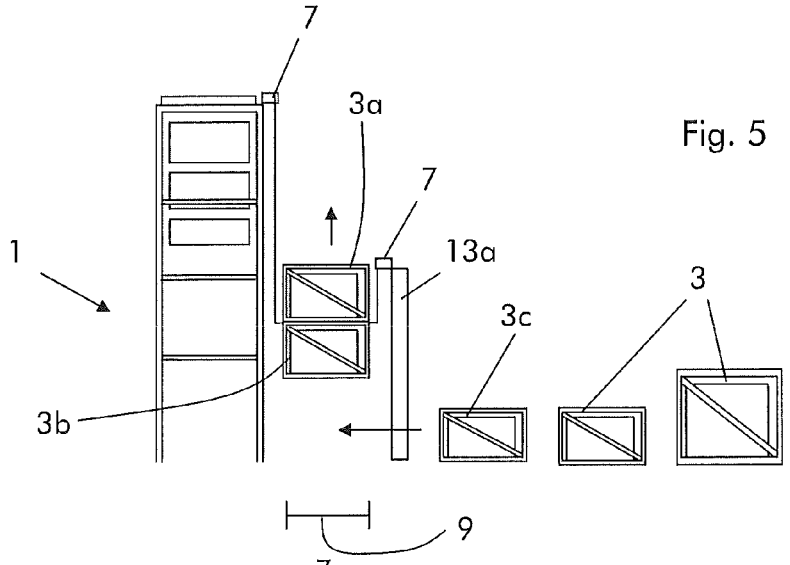
Figure 6:
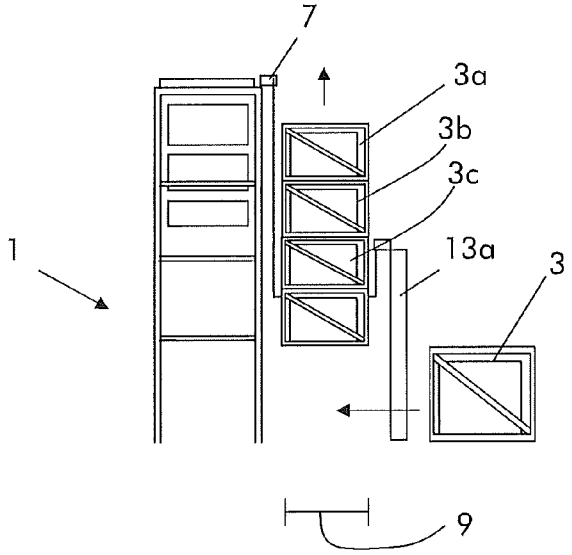

The group of modules is thus lifted of a height large enough to allow positioning of an additional module 3*c* below the group of modules; another additional module 3*c* is provided and the group of modules is positioned on the top of the additional module 3*c* (FIG. 5). The additional module 3*c* is thus connected to the group of modules.

Figure 7:
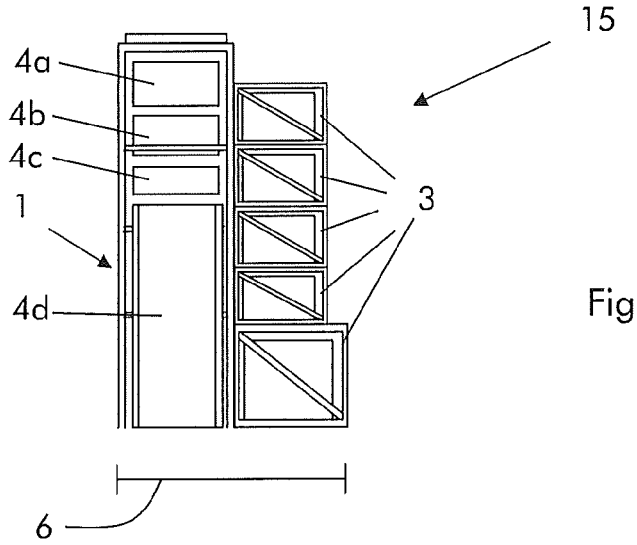

Lifting of the group of modules, providing and positioning of an additional module below the group of modules and connection of the additional module to the group of modules is repeated (FIG. 6) until all modules to be connected to the group of modules are installed (FIG. 7 shows a boiler).

In this example, the lifting towers height is adjusted to the highest module size (i.e. vertical size) and the strand jacks 7 are provided on the lifting towers 13*a* and on the main structure 1.

According to this method the modules to be installed at the upper part of the boiler are installed first and the modules to be installed at the lower part of the boiler are installed last.

In addition, even if preferably during installation the modules are positioned in their final footprint, this is not mandatory and for example the modules could be assembled outside their final footprint and then the group of modules (or partial group of modules in case only some of the modules are installed outside the final footprint) is moved in its final footprint.

This embodiment of the method is particularly advantageous, because no additional permanent structure is needed for supporting the modules 3 and in addition small space is needed for lifting the modules. In fact all the modules 3, 3*a*, 3*b*, 3*c* (or group of modules in case it is assembled outside the final footprint) can be lifted in their final footprint 9 (i.e. no additional space specifically for lifting the modules or group of modules is needed beside the final footprint of the modules).

Example 2—Erection with Temporary Lifting Structure Including a Bridge

Figure 8:
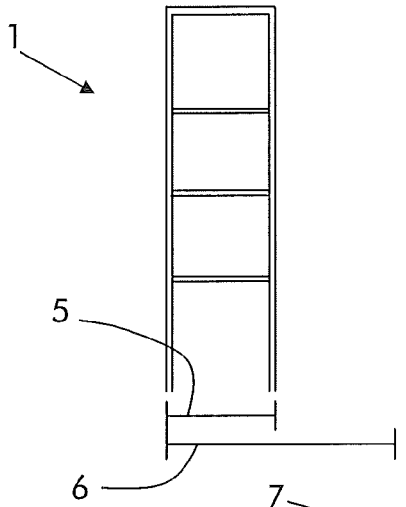
FIGS. 8 through 16 show a second embodiment of the method.
Figure 9:
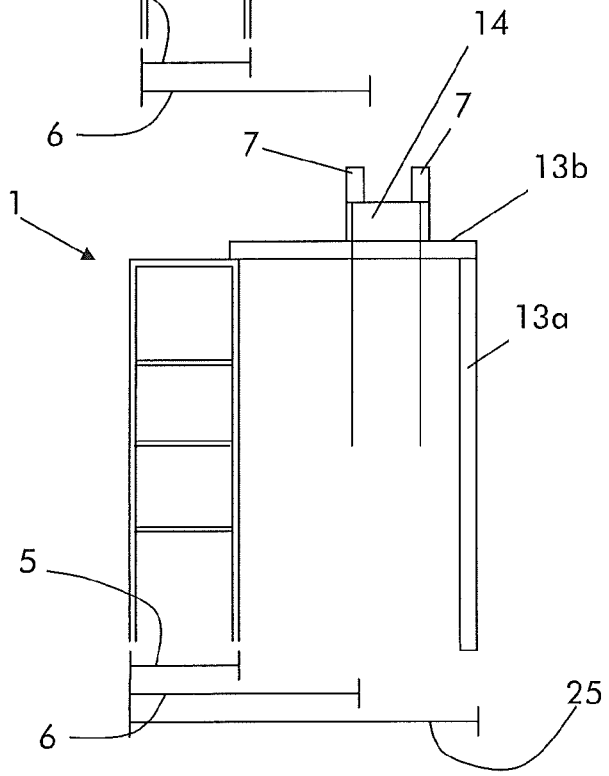
Figure 10:
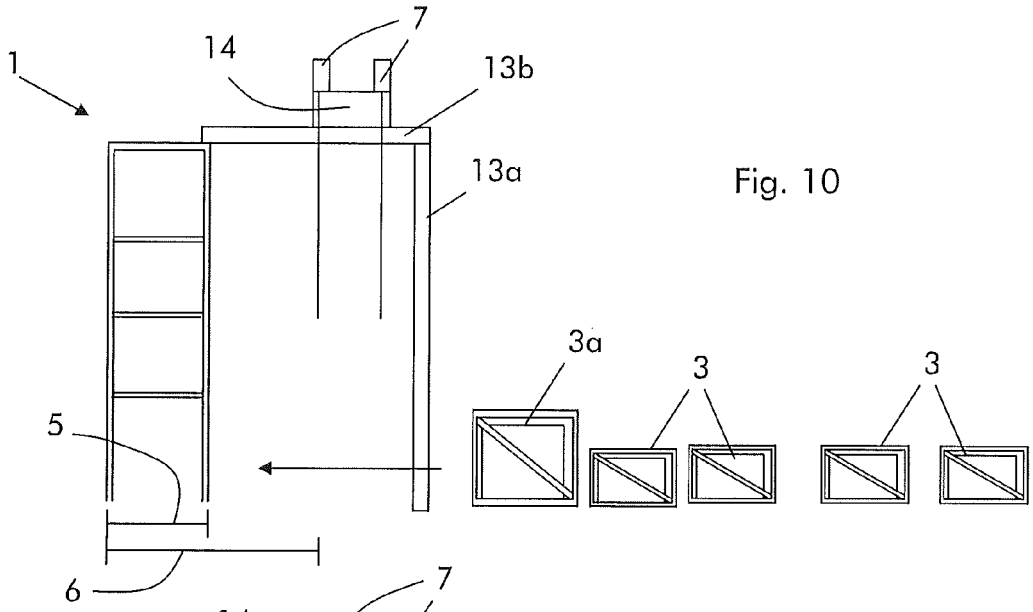

In a second embodiment of the invention (shown in FIGS. 8-16) the main structure 1 is built first (FIG. 8); then one or more temporary lifting structures are built beside the main structure 1 and connected to the main structure 1 (FIG. 9).

The temporary lifting structures include lifting towers 13*a* and bridges 13*b* connecting the lifting towers 13*a* to the main structure 1. Above the bridges 13*b* carriers 14 with strand jacks 7 are provided.

Figure 11:
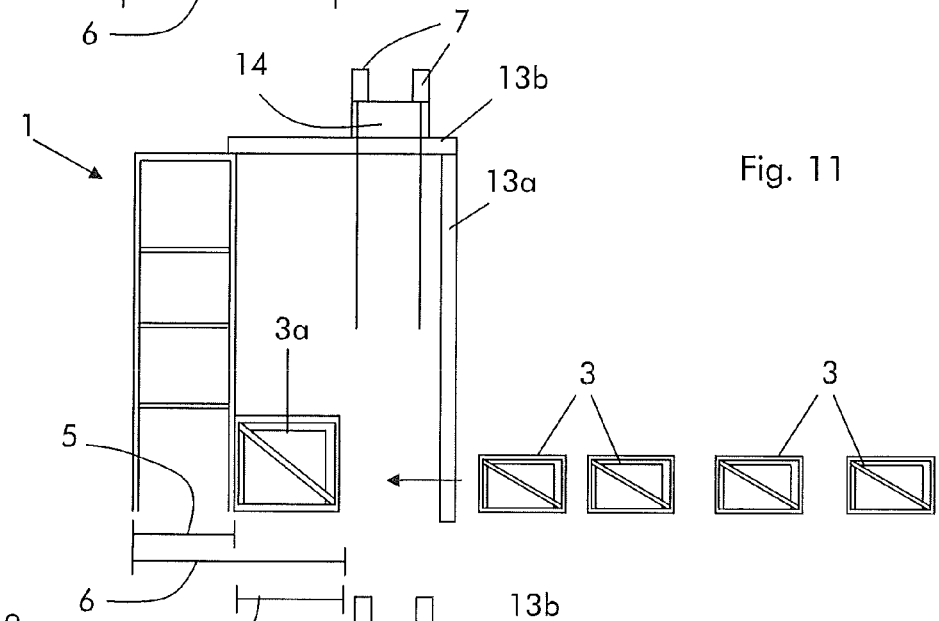
Figure 12:
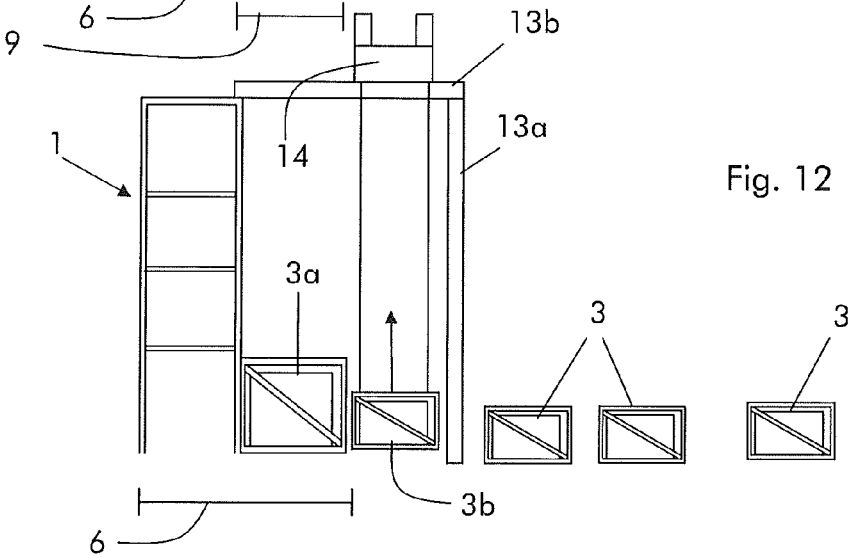
Figure 13:
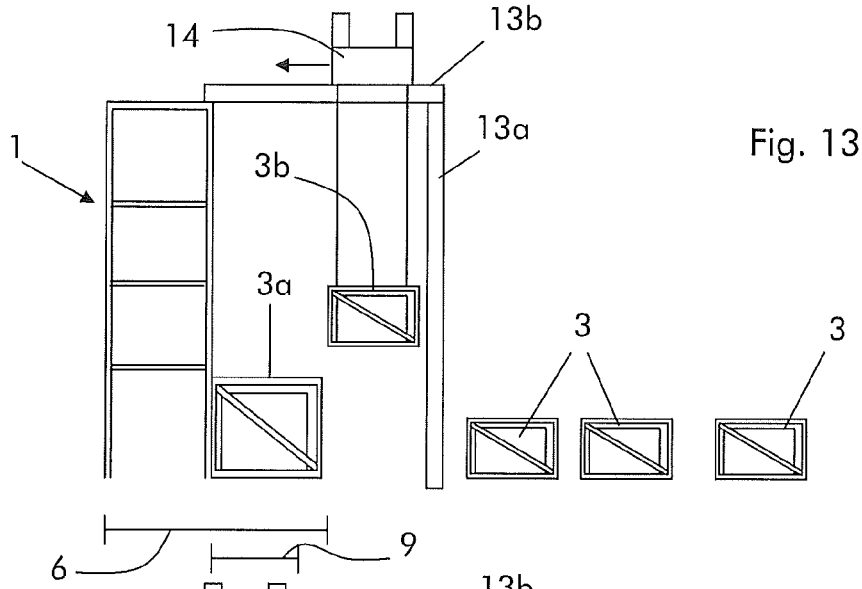
Figure 14:
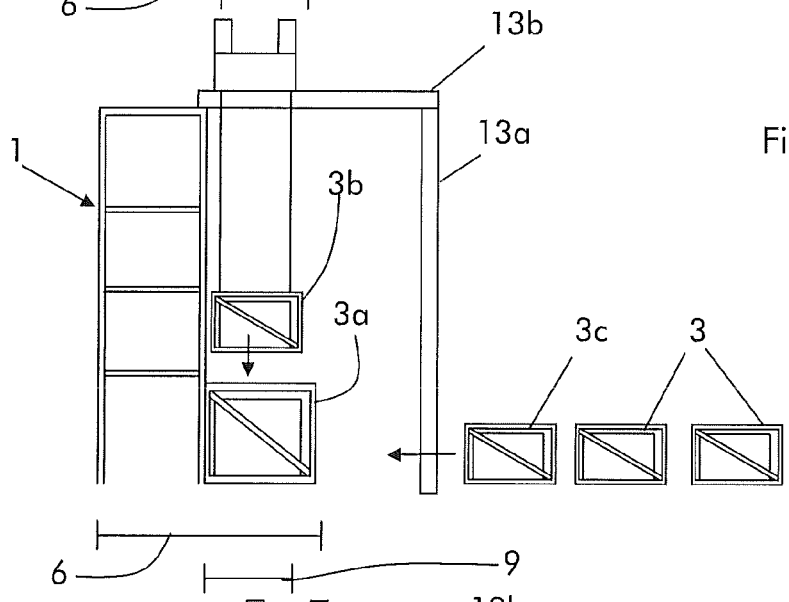
Figure 15:
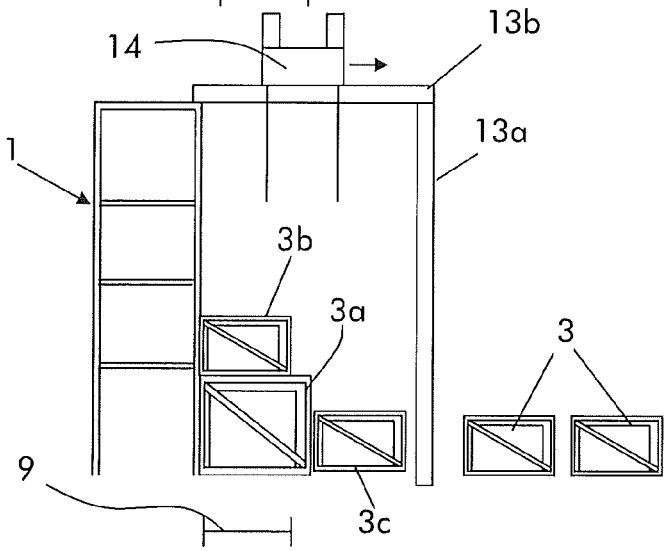

The modules 3 are provided ready to be installed (FIG. 10), then a module 3*a* is provided preferably in its final footprint (FIG. 11).

Then an additional module 3*b* is provided beside the module 3*a* and it is lifted by the strand jacks 7 (FIG. 12), it is moved by the carrier 14 (FIG. 13) and thus the additional module 3*b* is connected above the module 3*a* (FIG. 14) in order to define a group of modules.

Thus an additional module 3*c* is provided beside the module 3*a* (i.e. beside the group of modules 3*a* and 3*b*) (FIG. 15), it is lifted by the strand jacks 7, moved by the carrier 14 and connected above the group of modules.

Providing additional modules, lifting and connecting them above the group of modules is repeated until all modules to be connected to the group of modules are installed.

In this example, the temporary or permanent lifting towers are so high as the main structure 1.

According to this method the modules to be installed at the lower part of the boiler are installed first and the modules to be installed at the upper part of the boiler are installed last.

In addition, even if preferably during installation the modules are positioned in their final footprint, this is not mandatory and for example the modules could be assembled outside their final footprint and then the group of modules (or partial group of modules in case only some of the modules are installed outside the final footprint) is moved in its final footprint.

Figure 16:
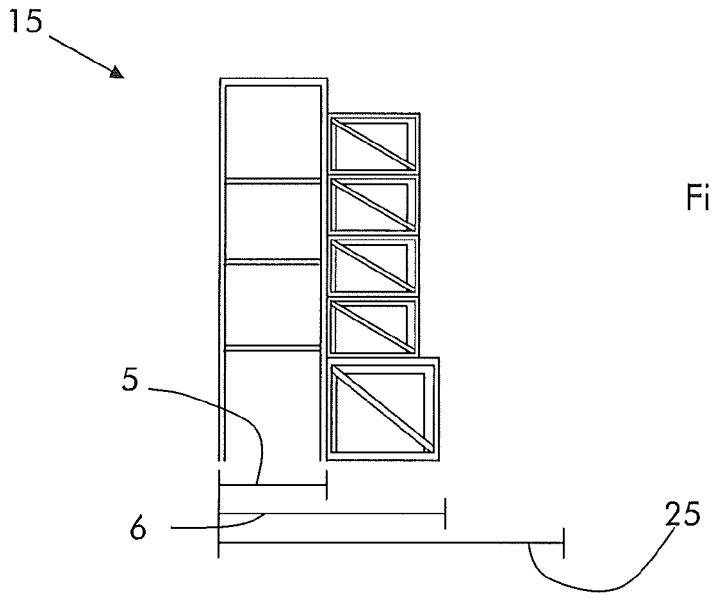

Finally the temporary lifting structures comprising the lifting towers 13*a* and bridges 13*b* are removed. FIG. 16 shows the boiler erected according to the second embodiment of the method; the temporary lifting structures are not shown because they were removed.

In other embodiments it is also possible to maintain the lifting structures as permanent lifting structures.

In this embodiment the space needed for lifting the modules 3 is higher than the footprint of the boiler 6; for example FIGS. 9 and 16 shows the footprint 6 of the boiler compared with the space 25 needed for installing the temporary lifting structure for lifting the modules.

Example 3—Erection with a Permanent Lifting Structure

Figure 17:
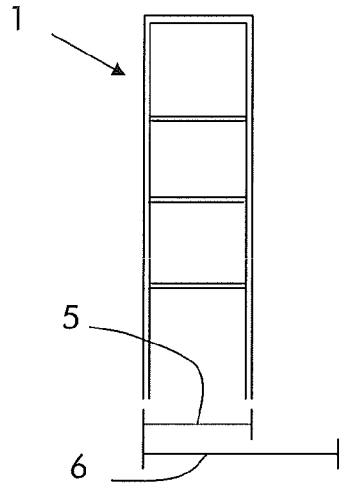
FIGS. 17 through 21 show a third embodiment of the method.

In a third embodiment of the invention (shown in FIGS. 17-21) the main structure 1 is erected first (FIG. 17) and while erecting the main structure 1, preassembling of the modules 3 can be started; preassembling of the modules 3 is carried out outside the footprint 6 of the boiler.

Figure 18:
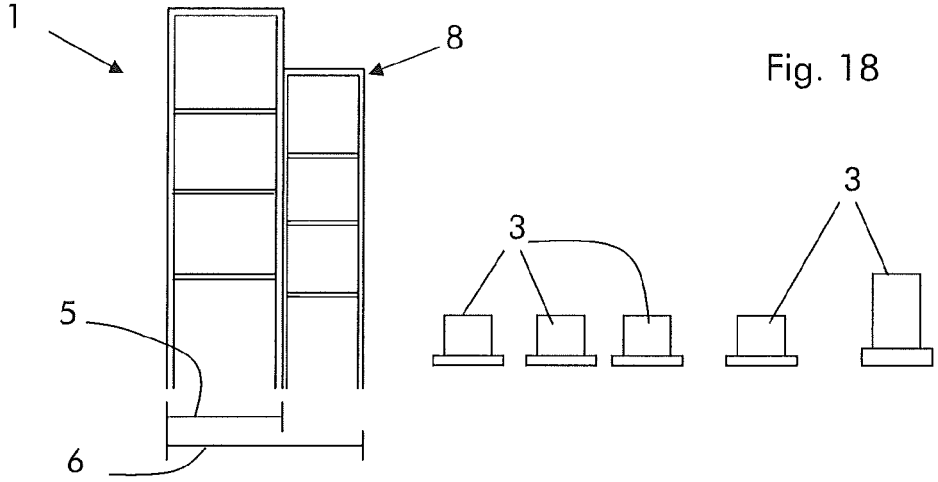

Then one or more permanent lifting structures 8 are also erected adjacent the main structure 1 (FIG. 18).

Figure 19:
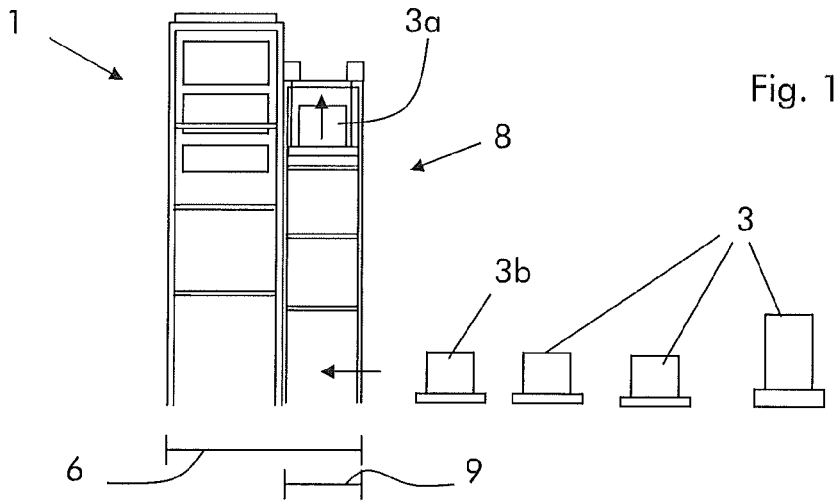

Thus a module 3*a* is provided, preferably in its final footprint 9 and is lifted in its final position (FIG. 19). The module 3*a* is then connected to the lifting structure 8 and/or to the main structure 1.

Thus an additional module 3*b* is provided, preferably in its final footprint 9, is lifted in its final position and is connected to the lifting structure 8 and/or to the main structure 1 and/or to the other adjacent modules 3*a*.

Figure 20:
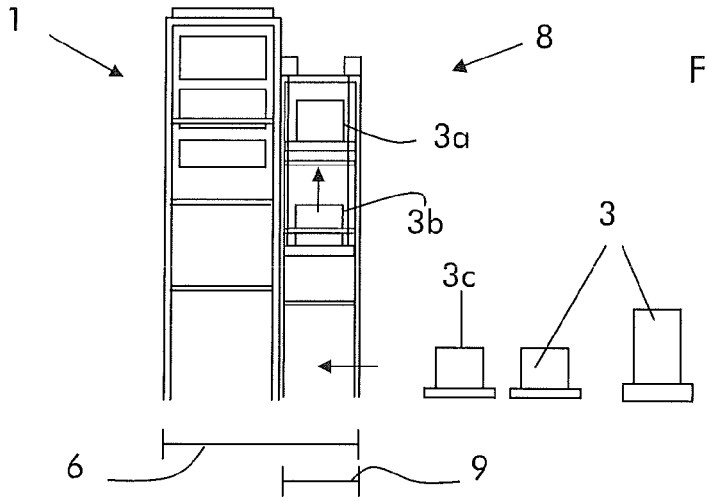

Providing, lifting and connecting modules is repeated until all modules to be connected to the permanent lifting structure 8 are installed (FIG. 20).

Figure 21:
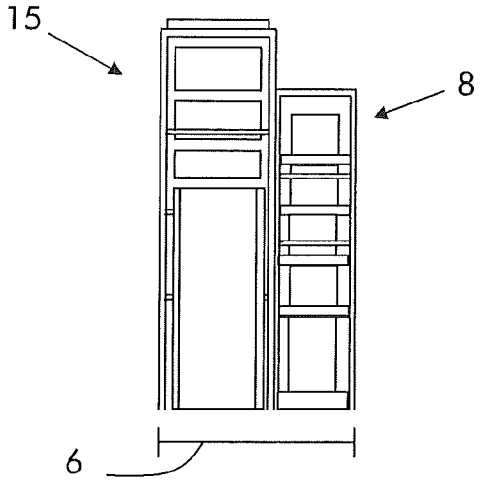
Figure 22:
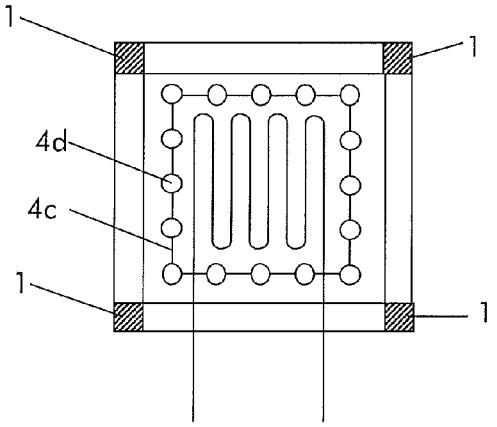
FIG. 22 shows a cross section of the main structure with the evaporating walls and the super heater.

FIG. 21 shows an example of a boiler erected according to the method in the third embodiment; in this case the permanent lifting structure 8 is shown because it is not removed.

According to this method the modules to be installed at the upper part of the boiler are installed first and the modules to be installed at the lower part of the boiler are installed last.

Modules

Figure 23:
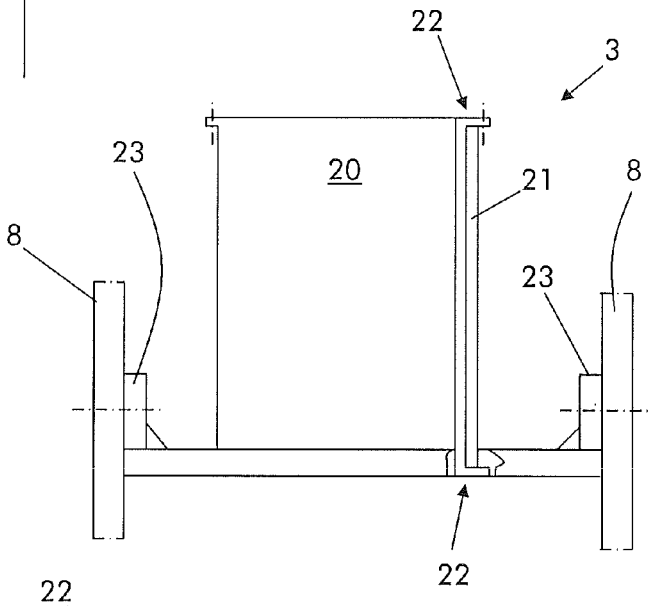
FIGS. 23 and 24 show two different examples of modules.
Figure 24:
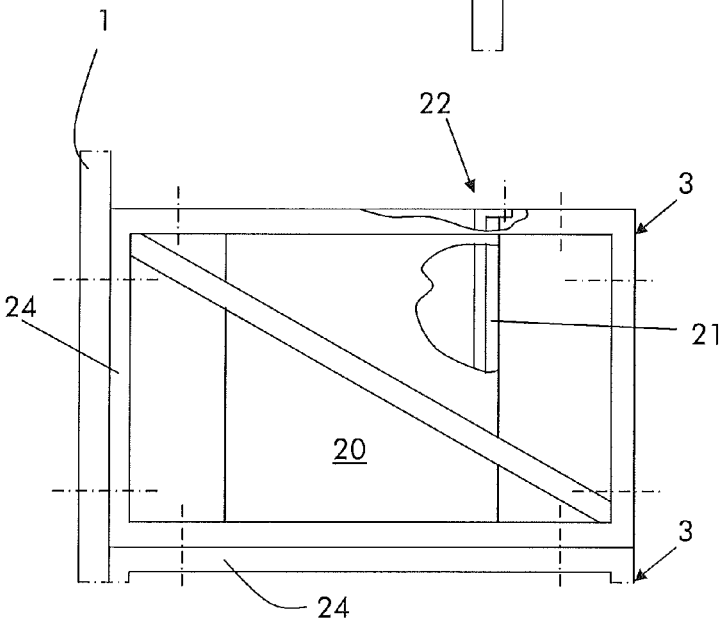

FIGS. 23 and 24 show examples of modules 3; the modules 3 for erecting the boilers comprise piping and/or insulation and/or auxiliaries and/or cable trays and/or ducts (such as for example sections of the flue gas duct) and/or gratings and/or hand rails and/or piping supports and/or electrical equipment.

Therefore the modules do not include the tubed heat-exchanging surfaces or at least do not include main components or parts of the tubed heat-exchanging surfaces.

In other words, the modules 3 preferably include a whole section of the boiler, such that no installation of additional components not included in the modules is needed; naturally reciprocal connection of components of different modules 3 or of a module 3 and a tubed exchanging surfaces 4*a-d* is possible and in some cases is needed.

It is also possible that some minor components on or between modules 3 will have to be installed after installation of the modules 3.

Advantageously, the modules 3 can be statical independent structures or not. Statical independent modules are modules that arc not connected together when installed in the boiler (like for example in example 3) and non statical independent modules are modules that are connected to each other when installed in the boiler (like in examples and 2).

FIG. 23 shows an example of a module 3 including a section of flue gas duct 20 with insulation 21 and flanges for connection to other flue gas ducts sections and flanges 23 for connection to the permanent lifting structure 8. This kind of modules is preferably used in connection with lifting structures 8 in the third embodiment of the method above described.

Additionally, the modules can also be provided with a module structure 24 that is connectable at least to the module structure 24 of other modules 3.

FIG. 24 shows an example of such a module, also FIG. 24 shows an example of a flue gas duct section 20 with insulation 21 and flanges 22 for connection to other flue gas duct sections and the module structure 24 that can be connected to other modules structures 24 or to the main structure 1. This kind of module is preferably used without a permanent lifting structure according to the first and second methods in the embodiments above described.

Naturally the features described may be independently provided from one another.

In practice the materials used and the dimensions can be chosen at will according to requirements and to the state of the art.

The invention claimed is:

1. A method for erecting a boiler comprising erecting a main structure: providing assembled modules defining boiler sections; and installing the modules outside the main structure, wherein the installing the modules outside of the main structure includes:

a) providing a module, b) providing an additional module beside the module, c) lifting the additional module and connecting the additional module above the module in order to define a group of modules, d) providing an additional module beside the group of modules, e) lifting the additional module and connecting the additional module above the group of modules, and f) repeating steps d) and e) until all modules to be connected to the group of modules are installed.

2. The method of claim 1, further comprising preassembling the modules on the ground.

3. The method of claim 1, further comprising pre-assembling the modules outside the final footprint of the boiler.

4. The method of claim 1, further comprising preassembling the modules during the main structure erection.

5. The method of claim 1, wherein the installing the modules outside of the main structure includes connecting the modules to one or more other modules and/or to the main structure and/or to a permanent lifting structure.

6. The method of claim 1, further comprising using, during steps c) and e), lifting structures whose height is as high as the main structure.

7. The method of claim 1, wherein during step a), the module is provided in its final footprint.

8. The method of claim 1 wherein each preassembled module comprise piping and/or insulation and/or auxiliaries and/or cable trays and/or ducts and/or gratings and/or hand rails and/or piping supports and/or electrical equipment.

* * * * *